United States Patent [19]

Kobayashi

[11] Patent Number: 5,062,815

[45] Date of Patent: Nov. 5, 1991

[54] SHIFT CONTROL FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 441,381

[22] Filed: Nov. 27, 1989

[30] Foreign Application Priority Data

Nov. 28, 1988 [JP] Japan ..... 63-301927

[51] Int. Cl.[5] ..... B63H 11/11

[52] U.S. Cl. ..... 440/41; 440/86; 440/87

[58] Field of Search ..... 114/270; 440/84, 86, 440/87, 40, 41

[56] References Cited

U.S. PATENT DOCUMENTS

| | | | |
|---|---|---|---|
| 2,743,624 | 5/1956 | Schroeder | 440/86 X |
| 3,426,724 | 2/1969 | Jacobson | 114/270 |
| 3,481,303 | 12/1969 | Tate et al. | 114/270 |
| 3,552,349 | 1/1971 | Snow | 114/270 |
| 3,693,577 | 9/1972 | Sade | 114/270 |
| 3,788,265 | 1/1974 | Moore | 440/41 |
| 3,797,447 | 3/1974 | Stubblefield | 440/41 X |
| 4,030,443 | 6/1977 | Price | 114/270 |
| 4,228,760 | 10/1980 | Kulischenko | 440/86 |

FOREIGN PATENT DOCUMENTS

| | | | |
|---|---|---|---|
| 920992 | 3/1963 | United Kingdom | 440/41 |

*Primary Examiner*—Sherman Basinger
*Attorney, Agent, or Firm*—Ernest A. Beutler

[57] ABSTRACT

A control arrangement for a small watercraft of the jet propulsion type having a reverse thrust bucket that is operated by a shift control. The shift control is positioned in relationship to the throttle control such that an operator can operate only one of the controls at a given time. In addition, the throttle control is biased to its neutral position so that when an operator releases his hand from the throttle control to effect a shift, the speed of the watercraft will be reduced.

4 Claims, 3 Drawing Sheets

SHIFT CONTROL FOR SMALL WATERCRAFT

BACKGROUND OF THE INVENTION

This invention relates to a shift control for a small watercraft and more particularly to an improved shift control that is positioned in a convenient location and which is operated in such a way to insure that the operator will not shift the direction of travel of the watercraft when the watercraft is operating at a high speed.

One form of particularly popular small watercraft is the jet propelled type that is designed to be operated by a single rider that is seated on the seat of the watercraft in a straddle-like fashion. This type of watercraft offers a wide variety of uses and in order to improve the usability of the watercraft it would be desirable to incorporate a shifting arrangement for the watercraft so that it can be operated in either a forward or a reverse direction. This can be accomplished by the provision of a reverse bucket that cooperates with the discharge nozzle of the jet propulsion unit so as to create a rearward thrust on the watercraft rather than the normal forward thrust. Of course, some form of operator control must be included so as to permit shifting of the reverse bucket from its normal forward position to its reverse position.

It is, therefore, a principal object of this invention to provide an improved shift control for a small watercraft.

It is a further object of this invention to provide a shift control for the reverse bucket of a small watercraft jet propulsion unit wherein the reverse bucket is operated by a shift lever that is positioned in proximity to the operator.

The type of jet propelled watercraft described has quite high performance. It is, therefore, also desirable to insure that the operator does not inadvertently shift the reverse bucket into its reverse position when the watercraft is operating at a relatively high speed. Alternatively, it is desirable to insure that the watercraft speed will be reduced when a shift to reverse is being made.

It is, therefore, a further object of this invention to provide an improved shifting arrangement for a small watercraft in which the speed of the watercraft will be reduced when the operator effects a shift.

It is a further object of this invention to provide an arrangement wherein the engine speed of a small watercraft having a jet propulsion unit is reduced when the operator shifts a reverse thrust bucket into its reverse position.

SUMMARY OF THE INVENTION

A first feature of this invention is adapted to be embodied in a small watercraft having a hull and a rider's area defining a seat for accommodating a rider seated therein in straddle fashion. A drive control is incorporated for effecting operation of the watercraft in either a forward drive mode or a reverse drive mode. In accordance with this feature of the invention, the drive control is located within the reach of a rider seated upon the seat.

A further feature of the invention is also adapted to be embodied in a small watercraft having a hull and a rider's area that accommodates a rider. A throttle control for controlling the speed of the watercraft is positioned in proximity to the rider's area and a shift control is also positioned in proximity to the rider's area for effecting either forward or reverse operation. In accordance with this feature of the invention, the throttle control and shift control are so located that an operator must remove his hand from the throttle control in order to effect operation of the shift control with that same hand.

BRIEF DESCRIPTION OF THE DRAWINGS

FIG. 5 is a partial perspective view showing the transmission control in its reverse drive mode.

DETAILED DESCRIPTION OF THE PREFERRED EMBODIMENT OF THE INVENTION

Figure 1:
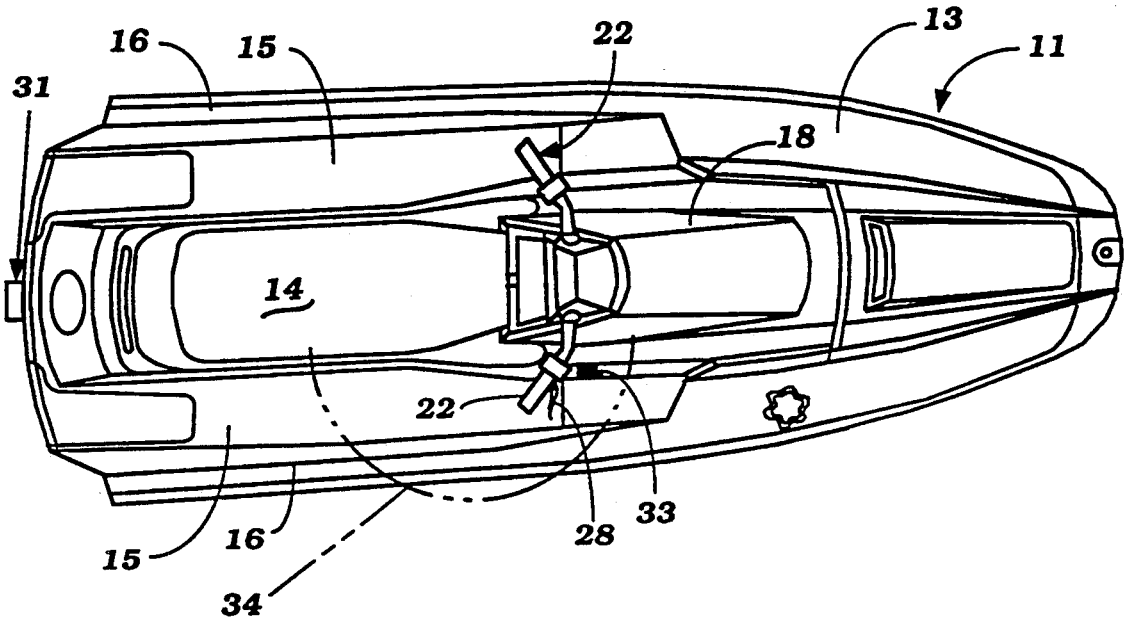
FIG. 1 is a top plan view of a small watercraft constructed in accordance with an embodiment of the invention.
Figure 2:
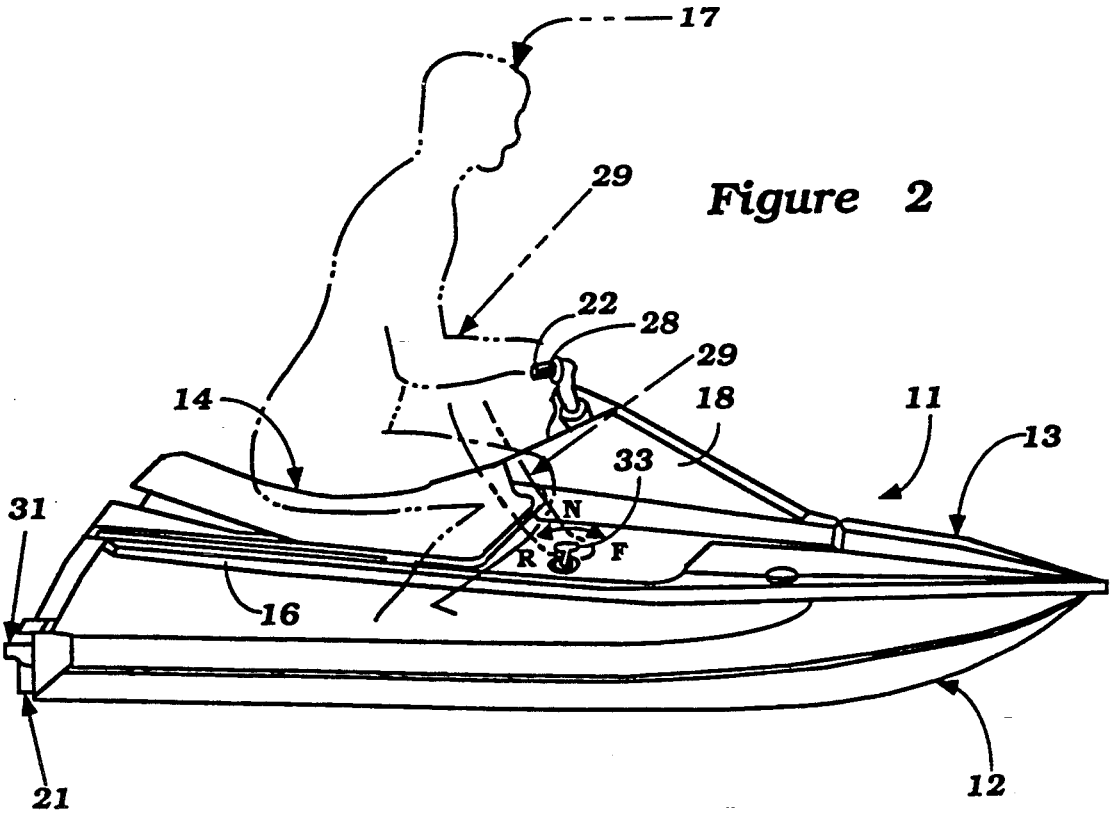
FIG. 2 is a side elevational view of the small watercraft showing a rider in phantom seated on the seat of the watercraft.
Figure 3:
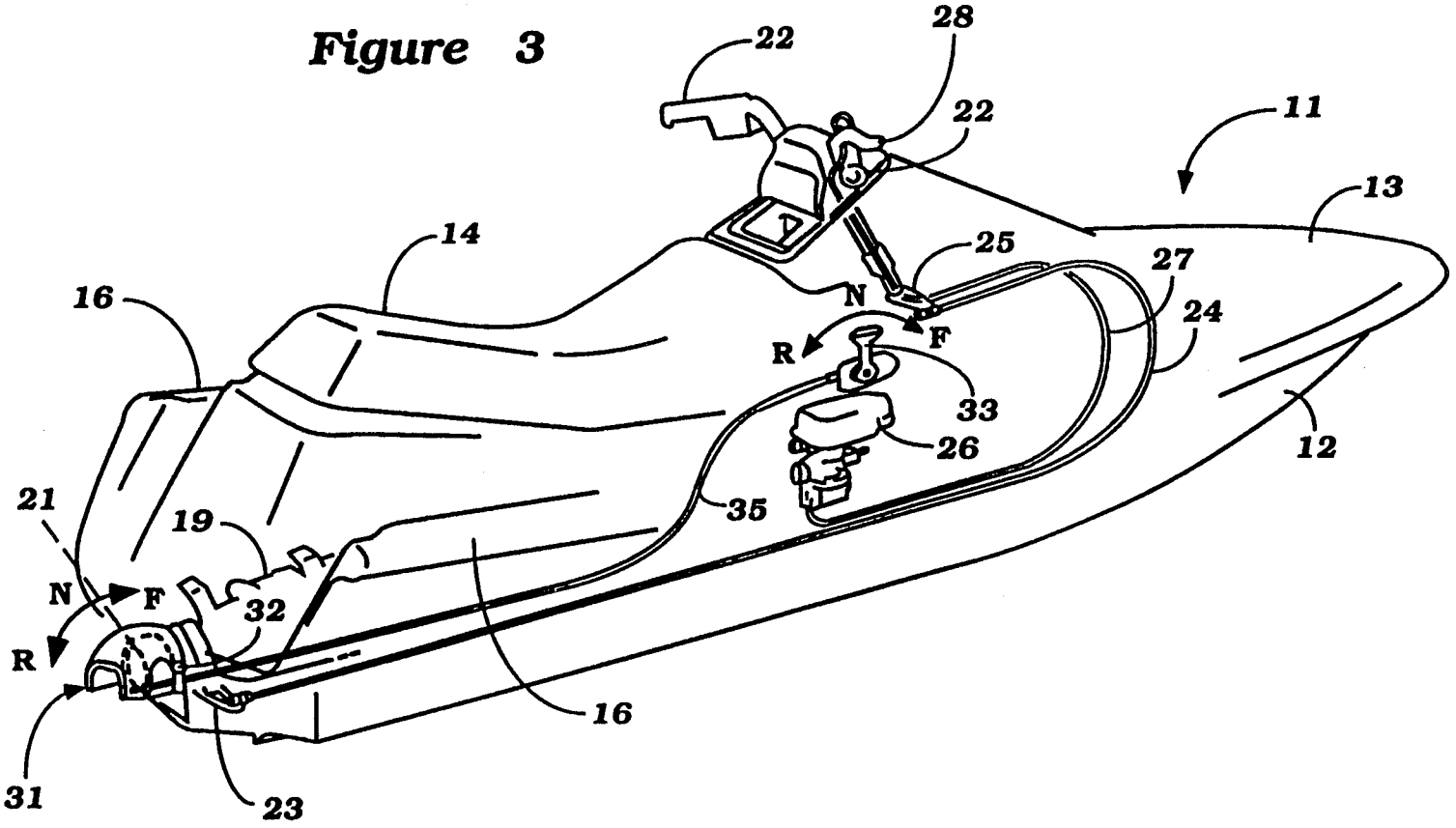
FIG. 3 is an enlarged perspective view from the rear and one side showing the transmission and throttle controls of the watercraft.
Figure 4:
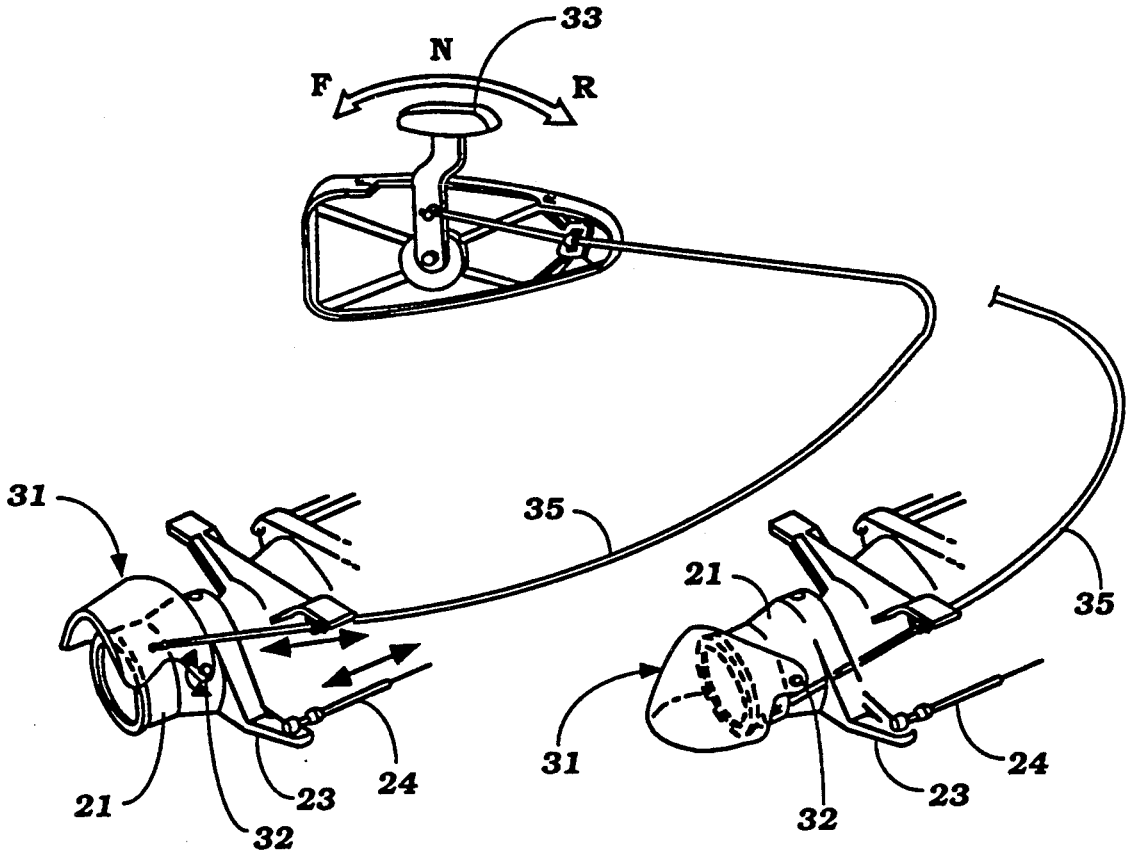
FIG. 4 is a further enlarged perspective view showing the transmission control in forward drive mode.

Referring first to FIGS. 1 through 3, a small watercraft constructed in accordance with an embodiment of the invention is identified generally by the reference numeral 11. The small watercraft 11 is depicted as being of the jet propelled type designed to be operated by a single rider seated in straddle fashion upon the seat of the watercraft 11. It is to be understood, however, that the invention may be utilized in conjunction with other types of watercraft. The invention has, however, particular utility in the type of watercraft described and depicted.

The watercraft 11 is comprised of a hull having a lower portion 12 and a deck portion 13 each of which may be formed conveniently from a molded fiberglass reinforced plastic as is well known in this art. A seat 14 is provided rearward of the deck 13 and has a pair of depressed foot areas 15 that are disposed on opposite sides thereof and which are positioned inwardly of raised gunnels 16. As may be seen, a rider, shown in phantom in FIG. 2 and identified generally by the reference numeral 17 may be seated on the seat 14 with his legs in the depressed foot wells 15.

A control bridge 18 is provided forwardly of the seat 14 on the deck 13 and an internal combustion engine (not shown) is positioned beneath the bridge 18 within an engine compartment formed by the hull 12 and deck 13. This internal combustion engine drives a jet propulsion unit, shown partially in FIG. 3 at 19 which is positioned within a tunnel formed at the rear of the hull beneath the seat 14. The jet propulsion unit 19 may be of any known type but includes a pivotally supported discharge nozzle 21 which is pivotal about a vertically extending axis for steering purposes as is well known in this art.

A handlebar assembly 22 is carried by the bridge 18 forwardly of the seat 14 and in a position wherein the operator 17 may conveniently steer the steering nozzle 21. As is common in this art, a steering lever 23 extends outwardly from one side of the steering nozzle 21 and is connected by means of a bowden wire 24 to a steering arm 25 formed at the lower end of the handlebar assembly 22 for steering of the watercraft 11.

Although the engine for the watercraft 11 is not depicted, it includes a throttle control mechanism. In the illustrated embodiment this constitutes the throttle valve of a carburetor shown in FIG. 3 and identified by the reference numeral 26. The bowden wire cable 27 extends from the throttle valve assembly to a throttle control lever 28 that is positioned on the handlebar assembly 22 in proximity to one of the rider's hands, indicated at 29 in FIG. 2. The throttle control mechanism is such that when the operator removes his hand 29 from the throttle control lever 28 the throttle valve of the carburetor 26 will be returned to its neutral position. Any suitable form of return spring arrangement may be employed for this purpose.

In accordance with the invention, the watercraft 11 is also provided with a shift mechanism for permitting the watercraft 11 to be operated selectively either in a forward, a neutral or a reverse operation. To this end, there is provided a reverse thrust bucket, indicated by the reference numeral 31 which is pivotally supported on the steering or discharge nozzle 21 of the jet propulsion unit 19 by means of a pair of transversely spaced apart pivot pins 32. The reverse thrust bucket 31 is pivotal from the forward drive position shown in FIGS. 1 through 4 to a neutral position (not shown) in which neither forward nor reverse thrust is generated to a reverse thrust position as shown in FIG. 5 wherein the jet propulsion unit 19 will power the watercraft 11 in a reverse direction.

A shift control lever 33 is carried by the hull and specifically by the deck portion 13 in proximity to the bridge 18 in an area encompassed by the phantom line 34 as shown in FIG. 1. The phantom line 34 is generated by the area where the operator's hand 29 may pass when the operator is seated in a normal position on the seat 14. However, the positioning of the shift lever 33 is such that the operator must remove his hand 29 from the throttle lever 28 before he can operate the shift lever 33 with that same hand. This insures that the speed of the watercraft will be reduced at such time as the operator is making a shift from either reverse to forward or neutral, or from forward to neutral or reverse, or from neutral to either forward or reverse. This offers obvious safety advantages.

A bowden wire cable 35 interconnects the shift control lever 33 with the reverse thrust bucket 31 for pivoting it between its respective described positions upon movement of the shift lever 33 between the forward, neutral and reverse positions as indicated in the figures.

It should be readily apparent from the foregoing description that the shift mechanism described provides great utility since the shift lever is easily within the reach of the operator but also affords safety since the operator must release the throttle before he can effect a shift. Although an embodiment of the invention has been illustrated and described, various changes and modifications may be made without departing from the spirit and scope of the invention, as defined by the appended claims.

What is claimed is:

1. A small watercraft having a hull, a rider's area defining an area to accommodate a rider, a throttle control positioned contiguous to the rider's area and on one side thereof for controlling the speed of said watercraft by the hand of a rider, said throttle control being spring biased to an idle position and requiring the pressure of the hand of the rider to hold the engine speed in any speed other than idle speed, and a drive control for effecting operation of said watercraft in either forward drive mode or reverse drive mode in proximity to that hand of a rider in said rider's area on that one side of the small watercraft said drive control being located on said one side of the small watercraft and spaced a sufficient distance below said throttle control such that a rider can operate only one of said controls with the same hand at a given time.

2. A small watercraft as set forth in claim 1 further including a steering handlebar assembly for steering the watercraft, said throttle control being supported on said handlebar assembly and said drive control being positioned contiguous to the handlebar assembly.

3. A small watercraft a set forth in claim 1 further including a jet propulsion unit for powering the watercraft, and a reverse thrust bucket cooperative with a discharge nozzle of the jet propulsion unit for effecting either forward or reverse thrust to the watercraft, and means for connecting said drive control to said reverse thrust bucket for operating said reverse thrust bucket.

4. A small watercraft as set forth in claim 3 wherein the jet propulsion unit is positioned in a tunnel beneath a seat of the watercraft in the rider's area.

* * * * *